US005407205A

United States Patent [19]

Larson

[11] Patent Number: 5,407,205

[45] Date of Patent: Apr. 18, 1995

[54] METHOD OF PLAYING A BOARD GAME

[76] Inventor: Laird L. Larson, 3826 N. Kenneth Ave., Chicago, Ill. 60641

[21] Appl. No.: 63,187

[22] Filed: May 18, 1993

[51] Int. Cl.[6] ..... A63F 3/00

[52] U.S. Cl. ..... 273/248

[58] Field of Search ..... 273/248, 249, 250–252, 273/243

[56] References Cited

U.S. PATENT DOCUMENTS

| | | | |
|---|---|---|---|
| D. 125,296 | 2/1941 | Vander Clute | 272/242 |
| D. 130,117 | 10/1941 | De Witt | 273/242 |
| D. 217,974 | 7/1970 | Deitch | 273/242 |
| D. 240,951 | 8/1976 | St. Cyr et al. | 273/243 |
| 614,543 | 11/1898 | Gerry | 273/243 |
| 2,273,009 | 2/1942 | Fisher | 273/248 |
| 4,030,762 | 6/1977 | Gilmore | 273/248 |
| 4,248,437 | 2/1981 | Lemberger et al. | 273/243 |

OTHER PUBLICATIONS

The Way to Play by the Diagram Group, Paddington Press Ltd., pp. 12–13, 1975.

Sears, Holiday Season Catalog, 1979 "Aggravation", p. 627.

*Primary Examiner*—Benjamin H. Layno

*Attorney, Agent, or Firm*—Willian Brinks Hofer Gilson & Lione

[57] ABSTRACT

The invention is directed to a method of playing a board game. A game board is provided having a base position, a home position and at least one track divided into segments, a plurality of the segments forming the apexes of a polygon. A first player is provided a marker initially positioned at the base position. A random number generator is used to produce a number which indicates the incremental movement of the marker along the track. The random number generator is actuated to produce a first number. The marker is moved from the base position along the track segments towards the home position. The random number generator is actuated to produce a second number. The marker is moved from the track segments to a first apex of the polygon. The random number generator is actuated to produce a third number. The marker is moved to a second apex of the polygon. The random number generator is actuated to produce a fourth number. The marker is moved from the second apex along the track segments toward the home position.

12 Claims, 3 Drawing Sheets

METHOD OF PLAYING A BOARD GAME

BACKGROUND OF THE INVENTION

The present invention relates generally to a method of playing a game. More particularly, this invention relates to a board game of chance and strategy to be played by a plurality of players.

Many people find playing board games to be a very enjoyable and relaxing way to spend an evening. However, there exists a need for a game suitable for players of all ages and keeps the interest of all the players over extended periods of time. Many complex games may keep the interest of a more experienced player over extended periods, but these games are often not suitable for many younger players. In addition, such complex games give an unfair advantage to players that have played that game in the past, since they have acquired knowledge of the intricacies of strategy and tactics essential for winning. In contrast, easier games often fail to possess a level of complexity necessary to keep the interest of all the players throughout the playing time.

Accordingly, there exists a need for a game capable of being played by both unskilled and experienced players. Yet, the game must offer a selection of strategy options for the mature player. The game must also introduce elements of chance for the relatively unskilled player so that the unskilled player has an opportunity to prevail over the more mature player.

SUMMARY OF THE INVENTION

Briefly stated, the present invention is directed to a method of playing a board game. A game board is provided having a base position, a home position and at least one track divided into segments, a plurality of the segments forming the apexes of a polygon. A first player is provided a marker initially positioned at the base position. A random number generator is used to produce a number which indicates the incremental movement of the marker along the track. The random number generator is actuated to produce a first number. The marker is moved from the base position along the track segments towards the home position. The random number generator is actuated to produce a second number. The marker is moved from the track segments to a first apex of the polygon. The random number generator is actuated to produce a third number. The marker is moved to a second apex of the polygon. The random number generator is actuated to produce a fourth number. The marker is moved from the second apex along the track segments toward the home position.

It is a primary object of this invention to provide a game based on competitive strategies for players that keeps the interest of all the players over extended periods of time. This invention, together with attendant objects and advantages, will be best understood with reference to the detailed description below read in conjunction with the accompanying drawings.

DETAILED DESCRIPTION OF THE PREFERRED EMBODIMENTS

The game board 10 of the present device is a generally rigid panel having a generally planar upper surface 12. If desired, the game board 10 may be provided with a hinge structure to enable the board to be folded into a more compact configuration. The game board 10 may be constructed from heavy cardboard, paperboard or other materials commonly used in the construction of game boards. The generally planar upper surface 12 may be imprinted with various game indicia or a separate piece of paper may be laminated to the board. The upper surface 12 may also include indentations for positioning a marker although a completely planar surface may also be used. It should be noted that the invention of the present game could also be displayed and played on a computer or a hand held device therefore obviating the necessity for a physical game board.

Figure 1:
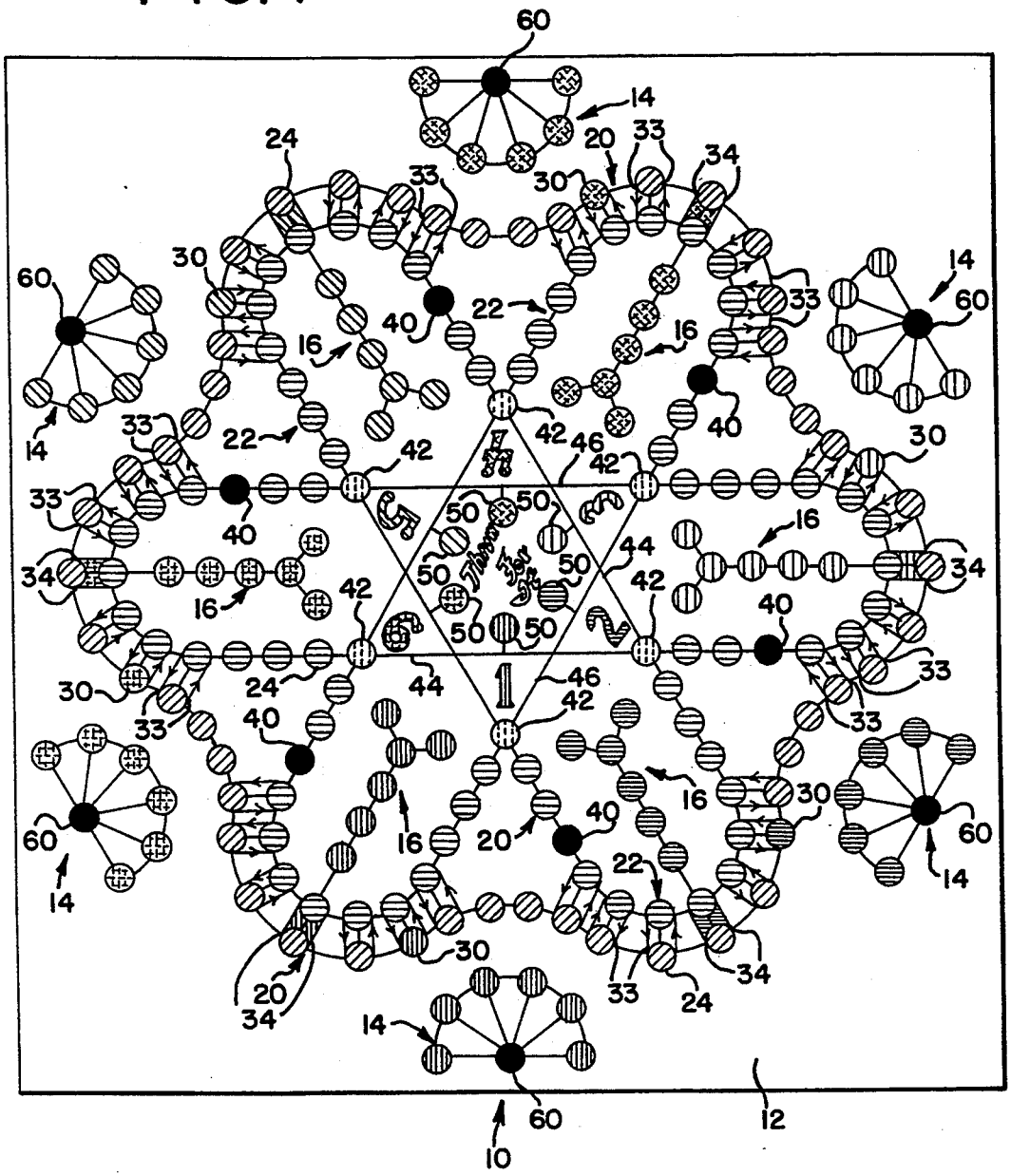
FIG. 1 is a top plan view of an embodiment of a game board according to the present invention.
Figure 2:
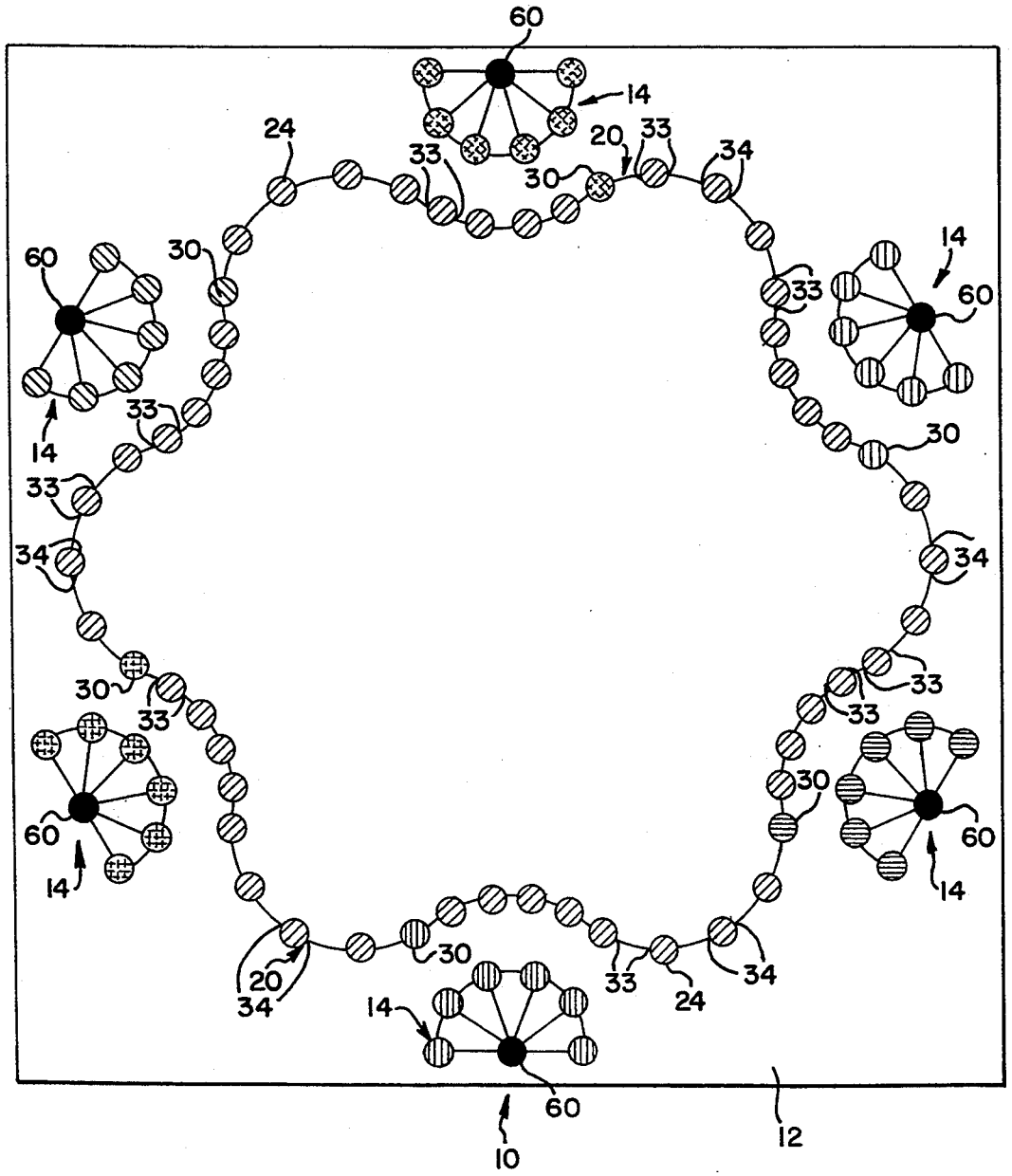
FIG. 2 is a top plan view of an outer track and base positions of the board game shown in FIG. 1.
Figure 3:
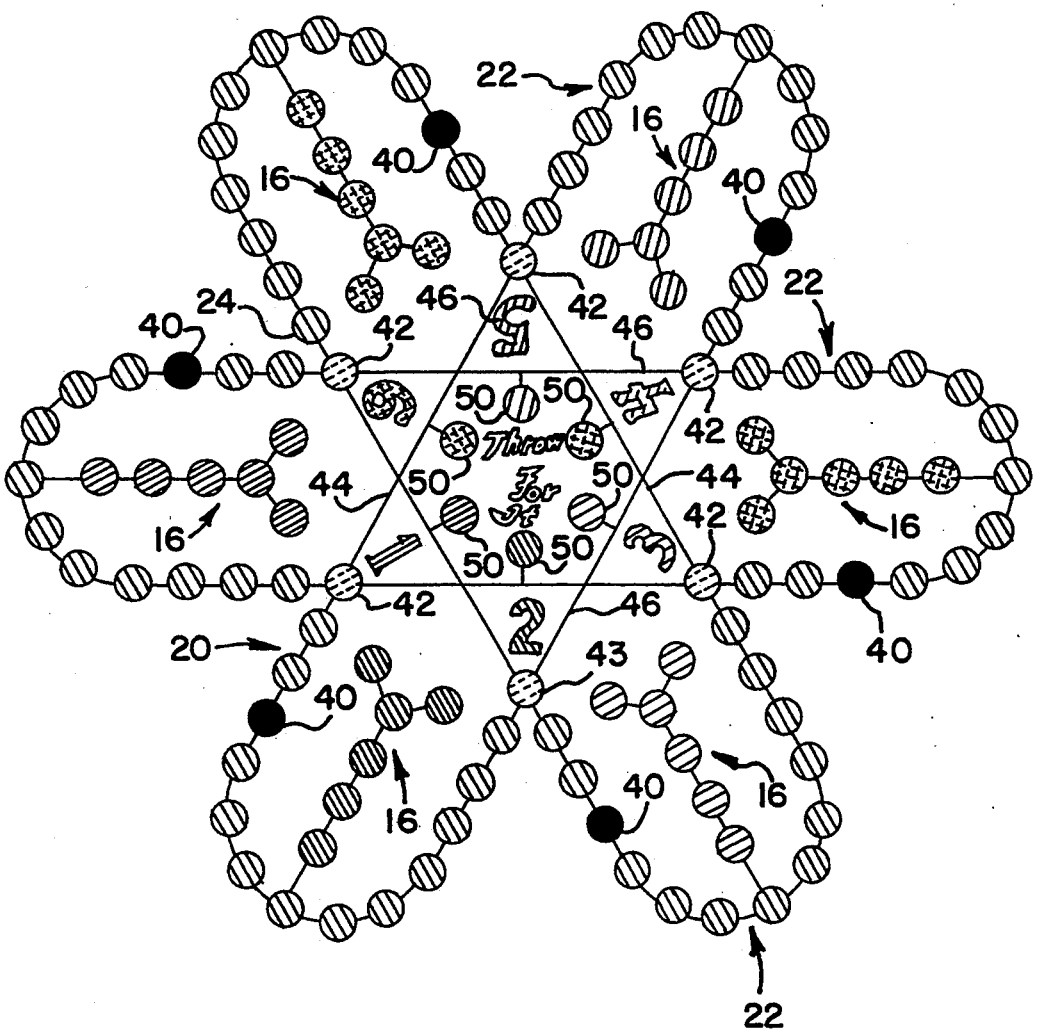
FIG. 3 is a top plan view of an inner track of the board game shown in FIG. 1.

As shown in FIGS. 1–3, the game board 10 has six color-coded base positions 14 and home positions 16. Generally one base position 14 and one home position 16 will be assigned to each player. Each base position 14 and home position 16 comprise six circular receptacles in the game board 10 to receive six markers to be hereinafter described. The board 10 includes a spaced apart outer track 20 and inner track 22. The outer track 20 and inner track 22 are divided into a plurality of spaced apart segments 24 each having a particular shape such as a circle. Segments 24 form a continuous path of movement from the base position 14 to the home position 16. The outer track 20 has a color-coded entry segment 30 denoting an entry position onto the outer track 20 from the base position 14.

Figure 4:
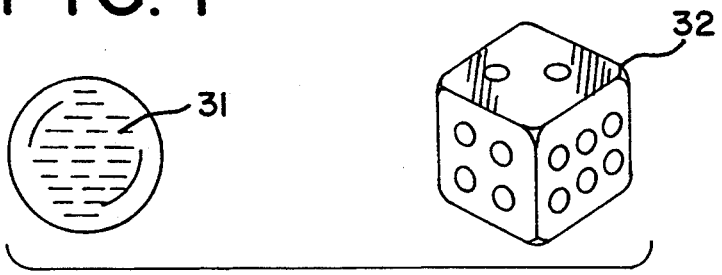
FIG. 4 shows an embodiment of a die and a marker to be used with the board game shown in FIG. 1.

The game of the present invention includes six markers for each of six possible players. Each player is assigned six markers having markings to readily identify one player's marker form another player's marker. The number of markers for each player correspond to the number of positions at the player's base position 14 and home position 16. In a preferred embodiment, as shown in FIG. 4, the markers may be color-coded marbles 31, however a wide variety of commonplace game markers may be used.

In play, the game objective is to be the first player to advance all six markers along the inner and outer tracks 20, 22 from the base position 14 in a counter-clockwise direction to the home position 16. All the markers for each player are initially positioned in their respective base positions 14 before the start of the game. Players alternate turns playing, wherein the order is determined by having each player produce a number on a random number generator. A random number generator, such as a conventional six-sided die 32 as shown in FIG. 4, is used to produce a number which indicates which player starts first with the player with the highest number starting first and so on. All turns are taken in a counter-clockwise direction. Any ties are resolved in a roll-off wherein the players who are tied actuate the random number generator until one achieves a higher number than the other player and so precedes the player with the lower number. The random number generator also indicates the incremental movement of a marker from the base position 14 along the outer track 20 and the inner track 22 toward the home position 16.

After determining which player starts first, a player attempts to have a marker exit the base position 14 by actuating the random number generator, i.e., throwing the die 32. If a one or six is produced by the die 32, a first marker is placed on the entry segment 30 of the outer track 20. Each player's turn at the game consists of one throw of the die 32, whereafter the next player to play takes his turn. However, if the number six is thrown, the player is permitted another turn. But, if a player throws a third number six that player must return a marker to the base position 14. Preferably, the marker closest to the home position 16 is returned to the base position 14.

Once a player's marker has left the base position 14 and landed on an entry segment 30, the player has several strategies available to him on how to move the marker to a corresponding home position 16. One strategy comprises moving the marker solely along the outer track 20. In such a strategy, the player would throw the die 32 and move the marker the corresponding number of segments in a counter-clockwise manner around the outer track 20. Some general rules of movement for this strategy and other plans of action include: (1) a marker can never move clockwise; (2) a player's marker may not jump over his own marker, but may pass or jump over an opposing player's marker; (3) a player's marker may land on a second of his markers or on an opposing player's marker resulting in the second marker or the opposing player's marker being returned to an available space at the base position 14; (5) only one marker may be moved per roll of the die 32; and (6) a marker must be used to complete a legal movement called for by the die 32.

At locations throughout the outer track 20 and the inner track 22, a plurality of elliptically shaped lines 33 interconnect a first inner track segment and a second outer track segment forming "jump points" to be hereinafter described. The "jump points" leading to the home position 16 of a player are color-coded and denoted as 34. After rolling the appropriate number, a player entering a "jump point" may move back and forth across the outer track 20 and the inner track 22. Thus, a player located on the outer track 20 moves to the inner track 22 and continues on the inner track to the appropriate home position 16. Note that while a player may never move backwards or reoccupy a previously occupied spot, a player may move back and forth across a "jump point" upon rolling a 3 or higher in order to land on a segment occupied by an opposing player thereby causing the opposing player's marker to be returned to the base position 14.

A player may close off a "jump point" by landing a first marker on one segment of the "jump point" and subsequently moving a second marker in accordance with the roll of the die 32 to the other segment of the "jump point." When two markers of the same player occupy both segments of a "jump point" a "blockade" is formed. A blockade prevents all players, including the player forming the blockade, from passing through the "jump point." None of the markers forming the "blockade" may be bumped and sent to the base position 14. This "blockade" can only be disbanded at the option of the player creating the "blockade." A player, however, may have to disband the "blockade", however, if necessitated by his turn (i.e. a player must always take a turn). A "blockade" may only be formed by one player.

If during the play of the game a player's marker is moving along the inner track 22, it may encounter one or more automatic return segments 40. A marker landing on segment 40 results in the marker being returned to the base position 14. Should the roll that caused the landing on segment 40 be a six, then no extra rolls are allowed. Note that it is also possible to employ automatic return segments on the outer track 20 as well.

Should the marker avoid the automatic return segments 40 on the inner track 22, they will encounter one or more apexes 42 forming a polygon, such as a hexagram as shown in FIGS. 1 and 3. In FIGS. 1 and 3, alternate apexes of the hexagram are joined by linear lines 43 (put in FIG. 1) forming a first triangle 44 and a second triangle 46 which together form a star-like shape. The apexes 42 of the polygon coincide with the points of the star-like shape. However, it is within the scope of this invention to create many different types of polygons.

Each apex 42 is numbered from 1 to 6 so as to correspond to the numerical characters of a standard six-sided die 32. As shown in FIGS. 1 and 3, the numbers 1–6 are imprinted on the board 10. However, this invention only requires one apex 42 to correspond to a number which can be produced by rolling the die. Once a player lands on an apex 42 exactly he has four options for further movement. The four options are not available to a player who does not exactly land on an apex, since that player must continue movement along the inner track 22.

One option is to move counter-clockwise from apex 42 to apex 42, wherein the number of apexes moved along by the marker is less than or equal to the number rolled. A player may exit from any apex 42 to the inner track 22. For example, if a four is rolled, the player may move his marker counter-clockwise to an adjacent apex 42 and move three spaces on the inner track 22. However, a player may not pass beyond the apex 42 leading to the player's home position 16. If a player's marker lands on a space occupied by a either a second of his markers or another player's marker, the second marker of the player or the other player's marker must be returned to its base position 14.

Another option for a player landing on an apex 42 is to move counter-clockwise across to an adjacent apex 42 of a corresponding triangle 42 or 44. This "triangle move" can only be used with a roll of 1–3 of the die 32. If a one is rolled, the marker is advanced to a next or second apex 42 of the triangle. If a two is rolled, the marker is advanced to the third apex 42 of the triangle. If a three is rolled, the marker advances around the triangle ending at the beginning apex 42. Any opposing player's marker in the triangle either landed on or passed up, must be returned to the base position 14. Furthermore, a player's marker cannot jump over or pass another of his markers positioned on the triangle 42 or 44.

A third option for a player landing on an apex occurs when a "1" is rolled at the next turn or more generally, for any player producing a number allowing movement directly to a numbered segment 50. In such a situation the player may elect to move his marker to a numbered segment 50 to participate in a phase known as "throw for it." The number of segment 50 corresponds to the number of the apex from which the marker came. By electing to "throw for it," the player throws the die one or more times, preferably three, in an attempt produce a number corresponding to the numbered segment 50. If the number corresponding to the numbered segment 50 is produced, the marker is moved to the home position 16 and if the number corresponding to the numbered segment is not produced the marker is moved to the base position 14. Accordingly, a significant element of chance is added to the game. Note that a player moving along the inner track 22 may participate in the "throw for it" phase by rolling a number which results in the marker landing on the numbered segment 50 exactly.

The fourth option is for the player to continue along the inner track 22.

Once a player participates in the "throw for it" phase, one or more other players may elect to enter a phase known as the "wager" phase. A player can only enter the "wager" phase if he has a marker located at the home position 16. The player will "wager" the marker in the home position 16 by placing it in an unoccupied numbered segment 50 thereby attempting to guess which number will be produced by a roll of the die 32. A black marker 60 is placed in home position 16 in which the "wagered" marker was previously located. The black marker 60 acts as a guide for the previous location of the "wagered" marker. The order in which players place their markers is determined by who is next in turn with respect to the "throw for it" player. Once the "wager" markers are placed in position, the "throw for it" player takes his turn by rolling the die 32 three times. If the number corresponding to the numbered segment 50 is successfully guessed, the "wager" player's marker is moved back to its original location at the home position 16 and an additional marker from the base position 14 is moved to the indentation of the home position 16 located nearest the inner track segment of "jump point" 34. However, if the number corresponding to the numbered segment 50 is not successfully guessed, then the "wager" player's marker (originally in the home position) is moved to the base position 14. The "wager" players must only return the marker risked in the "throw for it" move to the base position.

When a player has only one marker left on the inner track 20 or outer track 22 and the rest of his markers are in the home position 16 and occupy all available spaces in the home position 16 except for the space closest to the entrance, he may elect a "last chance maneuver." The player removes the marker and places it on one of the numbered segment 50. If after up to three rolls of the die 32, the number corresponding to the numbered segments 50 is produced, the player may move the marker to the remaining spot at the home position 16 thereby winning the game. If the number guessed is not produced, the marker must be returned to base position 14 together with an additional marker from the home position 16.

A second player may participate in the "last chance maneuver" if he also has only one marker remaining on the outer track 20 or the inner track 22 and the rest of his markers are at the home position 16 and occupy all available spaces in the home position 16 except for the space closest to the entrance. If more than one player participates in the "last chance maneuver", the first player to have his number thrown is the winner.

The embodiment described above is illustrative and not restrictive. The scope of the invention is indicated by the claims rather than by the foregoing description. The invention may be embodied in other specific forms without departing from the spirit of the invention. For example, the specific configuration of the outer track 20 and the inner track 22, the method of generating a random number or the specific form of the markers may be easily varied without departing from the spirit of the invention. The game may also be set up where two or more players form a team or where a player controls more than one set of markers. In such a situation, the game would progress as described above except when a player controls more than one set of markers he could alternate base positions 14 and could only wager markers equal to the number of sets of markers used. Accordingly, these and all other changes which come within the scope of the claims are intended to be embraced therein.

I claim:

1. A method of playing a board game comprising the steps of:

providing a game board having a base position, a home position and at least one track divided into segments, a plurality of the segments forming the apexes of discrete first and second polygons;

providing a first player marker initially positioned at the base position;

providing a random number generator to produce a number which indicates the incremental movement of the marker along the track;

actuating the random number generator to produce a first number;

moving the marker from the base position along the track segments towards the home position;

actuating the random number generator to produce a second number;

moving the marker from the track segments to a first apex of the first polygon;

actuating the random number generator to produce a third number;

selecting the next position of the marker in response to the third number from one of (1) a second apex of the first polygon and (2) a first apex of the second polygon; and moving the marker to the selected position.

2. A method of playing a board game according to claim 1 wherein the step of providing a game board comprises providing a game board wherein the first and second polygons each have three apexes.

3. A method of playing a board game according to claim 2 wherein the step of providing a game board comprises providing a game board wherein the first and second polygons overlap to form a star.

4. A method of playing a board game comprising the steps of:

providing a game board having a base position, a home position and a track having a first track and a second track each divided into segments wherein a first segment of said first track is interconnected to a second segment of said second track by a jump point;

providing a first marker for a first ,player initially positioned at said base position;

providing a random number generator to produce a number which indicates the incremental movement of the first marker along the track;

actuating the random number generator to produce a first number;

moving the first marker from the base position along the first track segments towards the home position;

actuating the random number generator to produce a second number; and moving the first marker from the first track to the second track by moving from the first segment to the second segment.

5. A method of playing a board game according to claim 4 further including the steps of:

actuating the random number generator to produce a third number;

moving the first marker along the second track toward the home position.

6. A method of playing a board game according to claim 4 further including the steps of:

occupying the second segment by the first marker;

providing a second marker for the first player;

actuating the random number generator to produce a third number;

moving the second marker to the first segment thereby preventing any other marker from passing therethrough.

7. A method of playing a board game comprising the steps of:

providing a game board having a base position, a home position and a track divided into segments having a first numbered segment;

providing a first marker for a first player marker initially positioned at the base position;

providing a random number generator to produce a number which indicates the incremental movement of the first marker along the track, the possible numbers having at least one in common with the numbered segment;

actuating the random number generator to produce a first number;

moving the first marker from the base position along the track segment towards the home position;

actuating the random number generator to produce a second number;

moving the first marker to a first numbered segment;

actuating the random number generator to produce a third number; and moving the first marker in response to the third number generated so that (1) if the third number corresponds to the numbered segment then the first marker is moved to the home position and (2) if the third number does not correspond to the numbered segment then the first marker is moved to the base position.

8. The method of playing a board game according to claim 7 further comprising the steps of:

providing a second player marker located at a home position before the generation of the third number;

the second player guessing the third number to be generated;

moving the second player marker in response to the number generated so that (1) if the third number corresponds to the numbered segment then the second player marker is moved to the home position and (2) if the third number does not correspond to the numbered segment then the second player marker is moved to the base position.

9. The method of playing a board game according to claim 8 further comprising the step of generating a plurality of third numbers.

10. A method of playing a board game comprising the steps of:

providing a game board having a base position, a home position and a track divided into segments having a first numbered segment;

providing a last marker for a first player marker initially positioned at the base position;

providing a random number generator to produce a number which indicates the incremental movement of the last marker along the track, the possible numbers having at least one in common with the numbered segment;

actuating the random number generator to produce a first number;

moving the last marker from the base position along the track segments towards the home position;

the first player guessing a second number to be generated;

actuating the random number generator to produce a second number; and moving the last marker in response to the second number generated so that (1) if the second number corresponds to the numbered segment then the last marker is moved to the home position thereby winning the game and (2) if the second number does not correspond to the numbered segment then the first marker is moved to the base position.

11. The method of playing a board game according to claim 10 further comprising the steps of:

providing a second player marker located on the track segments before the generation of the second number;

the second player guessing the second number to be generated;

moving the second player marker in response to the number generated so that (1) if the second number corresponds to the numbered segment then the second player marker is moved to the home position thereby winning the game and (2) if the third number does not correspond to the numbered segment then the second player marker is moved to the base position.

12. The method of playing a board game according to claim 11 further comprising the step of generating a plurality of second numbers.

* * * * *

UNITED STATES PATENT AND TRADEMARK OFFICE

CERTIFICATE OF CORRECTION

PATENT NO. : 5,407,205
DATED : April 18, 1995
INVENTOR(S) : Laird L. Larson

It is certified that error appears in the above-indentified patent and that said Letters Patent is hereby corrected as shown below:

Column 6, claim 4, line 58, delete "first ," and substitute --first,--.

Signed and Sealed this

Nineteenth Day of September, 1995

*Attest:*

Bruce Lehman

BRUCE LEHMAN

*Attesting Officer*

*Commissioner of Patents and Trademarks*